US006767853B1

(12) United States Patent
Nakayama et al.

(10) Patent No.: US 6,767,853 B1
(45) Date of Patent: Jul. 27, 2004

(54) FIBROUS SUBSTRATE FOR ARTIFICIAL LEATHER AND ARTIFICIAL LEATHER USING THE SAME

(75) Inventors: Kimio Nakayama, Okayama-ken (JP); Tsuyoshi Yamasaki, Okayama-ken (JP); Yoshihiro Tamba, Okayama-ken (JP)

(73) Assignee: Kuraray Co., Ltd., Kurashiki (JP)

( * ) Notice: Subject to any disclaimer, the term of this patent is extended or adjusted under 35 U.S.C. 154(b) by 12 days.

(21) Appl. No.: 09/610,222

(22) Filed: Jul. 3, 2000

(30) Foreign Application Priority Data

Jul. 5, 1999 (JP) ..... 11-190234

(51) Int. Cl.[7] ..... D02G 3/00; D02G 3/02; D02G 3/36; D04H 1/00; D04H 3/00; D04H 5/00; D04H 13/00

(52) U.S. Cl. ..... 442/361; 428/364; 428/365; 428/373; 428/904; 442/363; 442/364; 57/225; 57/226

(58) Field of Search ..... 57/225, 226; 428/904, 428/85–97, 334, 340, 341, 364, 365, 373; 442/361, 363, 364

(56) References Cited

U.S. PATENT DOCUMENTS

| | | | | |
|---|---|---|---|---|
| 4,515,854 A | | 5/1985 | Kogame et al. | |
| 4,612,228 A | * | 9/1986 | Kato et al. | 428/151 |
| 4,663,221 A | * | 5/1987 | Makimura et al. | 428/224 |
| 4,833,012 A | | 5/1989 | Makimura et al. | |
| 5,503,899 A | * | 4/1996 | Ashida et al. | 428/151 |

FOREIGN PATENT DOCUMENTS

| | | |
|---|---|---|
| EP | 08 51 090 | 5/1995 |

OTHER PUBLICATIONS

Database WPI, Section Ch, Week 199404, Derwent Publications, Ltd., Class F04, AN 1994–032268 & JP 05 339863, Dec. 21, 1993.

Database WPI, Section Ch, Week 199524, Derwent Publications, Ltd., Class A82, AN 1995–183410 & JP 07 102488, Apr. 18, 1995.

Database WPI, Section Ch, Week 199233, Derwent Publications Ltd., Class A28, AN 1992–273014 & JP 04 185777, Jul. 2, 1992.

Database WPI, Section Ch, Week 198516, Derwent Publications Ltd., Class A94, AN 1985–096719 & JP 60 045666, Mar. 12, 1985.

* cited by examiner

*Primary Examiner*—Elizabeth M. Cole
*Assistant Examiner*—Jeremy R. Pierce
(74) *Attorney, Agent, or Firm*—Oblon, Spivak, McClelland, Maier & Neustadt, P.C.

(57) ABSTRACT

A fibrous substrate for artificial leather, containing microfine fiber bundles, each of which is composed of 3–50 microfine fibers (A) containing an elastic polymer and having an average fineness of 0.5 denier or less and 15 or more microfine fibers (B) containing a non-elastic polymer and having an average fineness of 0.2 denier or less. The microfine fiber bundles satisfy the following conditions (1)–(3): (1) the ratio of the number of strands of the A to the number of strands of the B in cross sections of the bundles (A/B) is 1/5 or less, (2) the ratio of the weight of the A to the weight of the B in the bundles (A/B) is 10/90–60/40, and (3) the microfine fibers (B) containing the non-elastic polymer encircle each of the microfine fibers (A) comprising the elastic polymer.

15 Claims, No Drawings

FIBROUS SUBSTRATE FOR ARTIFICIAL LEATHER AND ARTIFICIAL LEATHER USING THE SAME

BACKGROUND OF THE INVENTION

1. Field of the Invention

The present invention relates to a fibrous substrate for artificial leather that has less rubbery feeling and repellence feeling than conventional artificial leather, is excellent in denseness feeling and has texture like soft natural leather.

2. Description of the Prior Art

At present, artificial leather is generally produced by a method which comprises impregnating a nonwoven fabric comprising fibers (referred to as microfine fiber-forming fibers) which are composed of a non-elastic polymer such as nylon or polyester and come to generate microfine fibers with a solution of an elastic polymer, mainly polyurethane, in an amount of 15–60% by weight of the nonwoven fabric, solidifying the elastic polymer by a wet process or a dry process, and then generating bundles of microfine fibers from the microfine fiber-forming fibers, or the like method. According to this method, the elastic polymer with which the fabric is impregnated is solidified into a sponge or block form to make a structure wherein the solidified elastic polymer covers and encircles the microfine fiber bundles. Therefore, the resultant artificial leather has strong rubbery feeling and repellence feeling that are peculiar to the elastic polymer, and is inferior to natural leather in feeling performances such as texture, drapeability, and denseness feeling and surface feeling of the surface. Since the elastic polymer is used in a solvent system, production steps such as solvent-recovery are complicated so that productivity is bad. In many cases, the solvent is harmful for human bodies. Thus, the above-mentioned method is involved in environmental problems upon the production.

Incidentally, natural leather is composed only of fibers and has a structure wherein several hundreds of very fine microfibrils of collagen are bundled into a fiber (about 0.05–1.0 denier); from several fibers to several tens of the fibers are made up to a fiber bundle (1–10 deniers); and microfibrils, fibers or fiber bundles are three-dimensionally and densely entangled with each other. For artificial leather, there are also suggested many trials for obtaining texture, denseness feeling and appearance that are very similar to those peculiar to natural leather, using a fibrous substrate composed only of fibers wherein a fibrous elastic polymer is used as a binder.

For example, Japanese Patent Application Laid-Open (JP-A) Nos. 59-211664, 59-211666, 60-45656, 60-139879, 63-12744, 64-52872, 2-14056 etc. disclose methods for producing a leather-like sheet by blending sea-island type microfine fiber-forming fibers whose island component is an elastic polymer with non-elastic fibers to prepare a nonwoven fabric, and then removing the sea component of the sea-island type microfine fiber-forming fibers to generate elastic microfine fibers. In these methods, pieces of the elastic polymer, which is the island component, agglutinate to each other to be bundled/integrated by treatment with the solvent upon extraction and removal of the sea component, even if the microfibers comprising the elasticpolymer are made sufficiently fine at the stage of the microfine fiber-forming fibers. Finally, a single thick fiber is produced. For this reason, the fineness of the elastic polymer that can be industrially produced exceeds 2 deniers. The elastic polymer and the non-elastic polymer are separately made into fiber bundles, so that only a part of the microfine fibers comprising the non-elastic polymer is bound with the elastic polymer. Thus, large parts of fibers comprising the non-elastic polymer are in a loose state. As a result, many of the microfine fibers are not bound and easily fall out from the leather-like sheet.

As examples of the fiber form in which an elastic polymer and a non-elastic polymer coexist in a single fiber bundle, JP-A Nos. 61-194247, 10-37057 etc. disclose methods using core-sheath type composite fibers wherein its core component is an elastic polymer and its sheath component is a blend polymer in which a non-elastic polymer is dispersed in an island form in a sea component comprising a soluble polymer. JP-A-Nos. 5-339863, 5-339864 etc. disclose methods using composite fibers wherein a soluble polymer in which an elastic polymer is dispersed in an island form and a soluble polymer in which a non-elastic polymer is dispersed in an island form are put on each other side-by-side. According to the former methods, the non-elastic polymer can be made into microfibers. However, the number of strands of the fiber comprising the elastic polymer is only one; therefore, the fineness of the elastic polymer that can be industrially produced is a large value over 1 denier. According to the latter methods, upon dissolution/removal of the soluble component, the elastic polymer agglutinates into thick fibers so that the fibers have strong repellence feeling and rubbery feeling. Thus, no artificial leather like natural leather can be obtained.

As described above, in all of the above-mentioned methods, the fineness of fibers comprising elastic polymer exceeds 1 denier and is too large as compared with natural leather. Therefore, no texture like natural leather can be obtained, and the denseness and smoothness of their surface are poor.

Examples using composite fibers wherein an elastic polymer and a non-elastic polymer are divided are disclosed in JP-A-Nos. 62-41375, 62-78246, 2-160964, 6-173173, etc. According to these methods, the industrial limits of both the fineness of fibers comprising the non-elastic polymer and that of fibers comprising the elastic polymer are about 0.5 denier. The fineness of both the obtained non-elastic fibers and elastic fibers is larger than that of natural leather. Texture like natural leather cannot be expected.

According to all of the methods, which have been disclosed up to the present, using an elastic polymer in a fiber form, the fineness of the elastic polymer is far larger than that of natural leather. As a result, texture and appearance are far and away from those of natural leather.

SUMMARY OF THE INVENTION

As described above, any elastic polymer cannot be made into microfibers according to the prior art, so that texture and appearance like natural leather cannot be gained. An object of the present invention is to attain conversion of an elastic polymer into microfibers and provide a fibrous substrate for artificial leather which has less rubbery feeling and repellence feeling than artificial leather in the prior art, has denseness feeling, and has texture and appearance like soft natural leather.

In order to obtain artificial leather having texture and appearance like natural leather, the inventors eagerly made investigations on methods by which an elastic polymer as an island component is made into microfine fibers without agglutination/integration of pieces of the polymer even if a sea component is extracted and removed with a solvent or the like. If microfine fibers (A) comprising an elastic polymer are adjacent to each other, they agglutinate to each other and are integrated into bundles upon the extraction and removal. Upon the extraction and removal, however, microfine fibers (B) comprising a non-elastic polymer do not agglutinate to each other. A hint was obtained from this fact.

Thus, the inventors tried a method wherein the microfine fibers (B) comprising the non-elastic polymer encircle the microfine fibers (A) comprising the elastic polymer for preventing the phenomenon that pieces of the elastic polymer are integrated into bundles. From microfine fiber-forming fibers wherein many microfine fibers (B) comprising the non-elastic polymer are substantially homogeneously dispersed in a sea component polymer containing many of the dispersed microfine fibers (A) comprising the elastic polymer, the sea component polymer is extracted and removed by a solvent. As a result, the elastic polymer is separated into microfibers, so as to form microfine fiber bundles wherein the micro fine fibers (A) comprising the elastic polymer and the microfine fibers (B) comprising the non-elastic polymer are blended and integrated with each other. In the resultant microfine fibrous substrate, the microfine fibers (B) comprising the non-elastic polymer cover and encircle the microfine fibers (A) comprising the elastic polymer, so as to make a fine entanglement structure, like natural leather, wherein the microfine fibers (B) comprising the non-elastic polymer near the microfine fibers (A) comprising the elastic polymer agglutinate to the microfine fibers (A). Thus, the substrate has texture and appearance like natural leather. As described above, the inventors have found the fact that by making an elastic polymer into microfibers, a dense and microfine fiber substrate like natural leather is made to give a leather-like sheet having texture and appearance like natural leather. Thus, the present invention has been made.

The present invention relates to a fibrous substrate for artificial leather, comprising microfine fiber bundles, each of which is composed of 3–50 numbers of microfine fibers (A) comprising an elastic polymer and having an average fineness of 0.5 denier or less and 15 or more numbers of microfine fibers (B) comprising a non-elastic polymer and having an average fineness of 0.2 denier or less, the microfine fiber bundles satisfying the following conditions (1)–(3):

(1) the ratio of the number of strands of the A to the number of strands of the B in cross sections of the bundles (A/B) is 1/5 or less, (2) the ratio of the weight of the A to the weight of the B in the bundles (A/B) is 10/90–60/40, and (3) the microfine fibers (B) comprising the non-elastic polymer encircle each of the microfine fibers (A) comprising the elastic polymer.

DETAILED DESCRIPTION OF the PREFERRED EMBODIMENTS

The leather-like sheet of the present invention can be obtained by performing the following steps (a)–(f):

the step (a) of producing microfine fiber-forming fibers that can be converted into microfine fiber bundles as described above, the step (b) of producing a fiber-entangled nonwoven fabric comprising the fibers, the step (c) of removing a sea component polymer constituting the fibers to convert the fibers into microfine fiber bundles comprising microfine fibers (A) comprising an elastic polymer (A) [hereinafter referred to as elastic microfine fibers (A)] and microfine fibers (B) comprising a non-elastic polymer (B) [hereinafter referred to as non-elastic microfine fibers (B)], and the step (d) of napping at least one surface of the resultant fiber bundles and dyeing the resultant fiber-napped sheet, or of applying a resin layer that will make a grain-like surface to at least one surface of the resultant fiber bundles.

In order to obtain artificial leather having high-class feeling such as texture and softness like natural leather and surface-denseness feeling, first, it is essential for the present invention that fibers comprising a non-elastic polymer is finer than fibers comprising an elastic polymer. In order to prevent agglutination and integration of fibers comprising an elastic polymer, it is essential for the present invention that fine fibers around the elastic polymer fibers are composed of a non-elastic polymer.

It is necessary for the present invention that the microfine fiber-forming fibers are in the following state: fibers comprising an elastic polymer and fibers comprising a non-elastic polymer are blended and integrated with each other in the sea component polymer and further the fibers comprising the elastic polymer and the fibers comprising the non-elastic polymer are substantially homogeneously dispersed in the whole of fiber cross sections without uneven distribution. That is, in side-by-side type fibers, wherein fibers comprising an elastic polymer and fibers comprising a non-elastic polymer are subjected to extremely uneven distribution, or the like fibers, the non-elastic microfine fibers (B) cannot sufficiently encircle the elastic microfine fibers (A) so that the pieces of the elastic polymer agglutinate strongly to each other in the microfine fiber-making step. As a result, microfibers cannot be obtained. Thus, these fibers are not preferred in the present invention.

Such microfine fiber-forming fibers can be obtained as follows:

1) a spinning method comprising blending the non-elastic polymer constituting the non-elastic microfine fibers (B) with the sea component polymer at a prescribed blend ratio, melting the blend in a single melting system, and causing this to flow together with the elastic polymer constituting the elastic microfine fibers (A) melted in another system, with the fiber shape being defined through a spinneret portion, 2) a spinning method comprising blending the elastic polymer constituting the elastic microfine fibers (A) with the sea component polymer at a prescribed blend ratio, melting the blend in a single melting system, and causing this to flow together with the non-elastic polymer constituting the non-elastic microfine fibers (B) melted in another system, with the fiber shape being defined through a spinneret portion, 3) a spinning method comprising blending the non-elastic polymer constituting the non-elastic microfine fibers (B) with the sea component polymer at a prescribed blend ratio, melting the blend in a single melting system, blending the elastic polymer constituting the elastic microfine fibers (A) melted in another system with the sea component polymer at a prescribed ratio, melting the blend in a single melting system, and causing these to flow into each other with the fiber shape being defined through a spinneret portion, 4) a spinnng method comprising repeating joint-division plural times at a spinning head portion to form a blend system of the two instead of the spinning manner of defining the fiber shape through the spinneret portion in the above-mentioned methods, or the like spinning method. Among these methods, the above-mentioned method 1) or method 4) is preferred since the microfine fiber-forming fibers defined in the present invention can easily be obtained.

In order to produce microfibers without agglutination and integration of pieces of the elastic polymer upon extraction and removal of the sea component polymer with a solvent or the like, it is necessary in the present invention that the microfine fiber-forming fibers are produced to have a structure in which the number of strands of the elastic microfine fibers (A) is 3–50 and the number of strands of the non-elastic microfine fibers (B) is 15 or more in any cross section along the direction perpendicular to the fiber axis of any one of the microfine fiber bundles, the ratio of the numbers of strands (A/B) is 1/5 or less, and the elastic microfine fibers (A) and the non-elastic microfine fibers (B) are blended and integrated in the microfine fiber bundles. The structure wherein the elastic microfine fibers (A) and the non-elastic microfine fibers (B) are blended and integrated means a state in which the elastic microfine fibers (A) and the non-elastic microfine fibers (B) are substantially dispersed in the whole of any cross section of the bundle without locally uneven distribution.

When the number of strands of the elastic microfine fibers (A) is over 50, the elastic microfine fibers (A) are too close to each other so that the elastic microfine fibers (A) agglutinate to each other and are integrated upon the extraction and removal of the sea component to make a structure wherein the non-elastic microfine fibers are also taken therein. As a result, the structure becomes too dense so that its texture is hard and mechanical properties such as tear strength deteriorate. On the other hand, if the number of strands of the elastic polymer fibers is below 3, the average fineness of the elastic polymer exceeds 1 denier so that surface denseness and smoothness deteriorate. Besides, the elastic polymer having a large fineness is bared to the surface of the substrate. Because of high frictional resistance thereof, rough-surface feeling becomes strong. When this is used for dyed articles, color spots of the elastic polymer against the non-elastic polymer become conspicuous so that its appearance deteriorates. When the weight proportion of the elastic polymer is lowered, the average fineness of the elastic polymer can be lowered. In this case, however, the resultant artificial leather is like dish cloth and has poor texture. Preferably, the number of strands of the elastic polymer fibers is 5–45.

When the number of strands of the non-elastic microfine fibers (B) is below 15, the shield of the elastic microfine fibers (A) is insufficient. Thus, the elastic microfine fibers (A) agglutinate to each other and are integrated upon the extraction and removal of the sea component to make a structure wherein the non-elastic microfine fibers are also taken therein. Besides the content by percentage of the non-elastic polymer is preferably about 50% or more in the light of the process and practical use. Therefore, the fineness of the non-elastic polymer that can be industrially produced is as large as about 0.2 denier or more. As a result, the resultant product has hard texture and poor mechanical properties such as tear strength. The number of the non-elastic microfine fibers (B) is 15 or more, preferably 25 or more, and more preferably 50 or more. The number of strands is preferably 5000 or less from the viewpoint of production easiness.

When the ratio of the number of strands of the elastic microfine fibers (A) to that of the non-elastic microfine fibers (B) (A/B) is over 1/5, the non-elastic microfine fibers (B) cannot sufficiently encircle the elastic microfine fibers (A). Thus, the elastic microfine fibers (A) agglutinate to each other and are integrated upon the extraction and removal of the sea component to make a structure wherein the non-elastic microfine fibers are also take therein. As a result, the structure becomes too dense so that its texture is hard and mechanical properties such as tear strength deteriorate. The ratio between the above-mentioned numbers of strands (A/B) is preferably 1/10 or less. The ratio is preferably 1/2000 or more from the viewpoint of production easiness. The ratio of the average fineness of the elastic microfine fibers (A) to that of the non-elastic microfine fibers (B) (A/B) is preferably in the range of 2 to 5000 and more preferably from 5 to 500 from the viewpoint of easy attainment of the object of the present invention and easiness of fiber production.

It is necessary that the weight ratio of the A to the B (A/B) in the microfine fiber bundles ranges from 10/90 to 60/40. When the proportion of the A is over 60/40, practical performances such as no mechanical properties do not reach a sufficient level. Besides, the repellence feeling and rubbery feeling that are peculiar to the elastic polymer become strong. Moreover, the elastic microfine fibers (A) are too close to each other so that the elastic microfine fibers (A) agglutinate to each other and are integrated upon the extraction and removal of the sea component to make a structure wherein the non-elastic microfine fibers are also taken therein. Consequently, the resultant product has hard texture, and has rubbery feeling and repellence feeling. Thus, practical performances deteriorate. Conversely, when the weight ratio (A/B) is below 10/90, the elastic polymer is made into microfibers. However, part of the non-elastic microfine fibers (B) that are not close to the elastic microfine fibers (A) increases so that the amount of the non-elastic microfine fibers (B) which do not bind the elastic microfine fibers (A) increases. Thus, the resultant structure becomes loose so that texture like natural leather cannot be obtained. Besides, the fibers come to have pores. Thus, problems about the process or practical use arise. The weight ratio (A/B) is preferably in the range of 15/85 to 55/45.

When the average fineness of the elastic microfine fibers (A) is over 0.5 denier, the repellence feeling peculiar to the elastic polymer is raised. Further, surface denseness and smoothness deteriorate. Thus, it is difficult that the resultant keeps texture and appearance like natural leather. The average fineness of the elastic microfine fibers (A) is preferably 0.3 denier or less, and more preferably 0.2 denier or less, and is preferably 0.005 denier or more. When the average fineness of the non-elastic microfine fibers (B) is over 0.2 denier, the resultant product has hard texture. Besides, problems about surface denseness and smoothness arise. Thus, it is difficult that the resultant keeps texture and appearance like natural leather. The average fineness of the non-elastic microfine fibers (B) is preferably 0.15 denier or less, and more preferably 0.1 denier or less, and is preferably 0.0002 denier or more.

In the microfine fiber-forming fibers of the present invention, the elastic polymer constituting the elastic microfine fibers (A) as an island component means any polymer whose elongation recovery ratio at the time of 1 minute after the polymer is elongated by 50% at room temperature is 50% or more. The non-elastic polymer means any polymer whose elongation recovery ratio measured in the same manner for the non-elastic polymer is 50% or less, or any polymer whose limit elongation ratio does not reach 50% at room temperature.

Examples of the elastic polymer include polyurethanes obtained by reacting at least one selected from polymer polyols having a number-average molecular weight of 500 to 3500, such as polyester polyols, polyether polyols, polyester ether polyols, polylactone polyols, polycarbonate polyols and the like with an organic diisocyanate such as 4,4'-diphenylmethane diisocyanate, tolylene diisocyanate, isophorone diisocyanate, dicyclohexylmethane-4,4'-diisocyanate or hexamethylene diisocyanate and a chain extender having two active hydrogen atoms, such as 1,4-butane diol or ethylenediamine; ester-based elastomers such as polyester elastomers and polyether ester elastomers; amide-based elastomers such as polyether ester amide elastomers, polyester amide elastomers; block copolymer polymers having in the molecular thereof a conjugated diene-based polymer or a conjugated diene-based polymer block such as polyisoprene or polybutadiene; and melt-spinnable elastomers having rubber elasticity. Above all, polyurethanes are most preferable since their softness and frictional resistance are high and their repellence is low so as to produce an effect for binding non-elastic microfine fibers and their heat resistance and endurance are high.

The non-elastic polymer constituting the non-elastic microfine fibers (B) as the island component has a function for separating the microfine fibers (A) of the elastic polymer without agglutination thereof and making them into microfibers. Therefore, it is preferred to select a non-elastic polymer, the pieces of which do not agglutinate to each other by treatment with a solvent used for extraction and removal of the sea component. Specifically, preferable is a polymer having a solvent swelling ratio, following the treatment, of 10% or less by weight. Such a non-elastic polymer is at least one melt-spinnable polymer that is selected from melt-spinnable polyamides such as nylon-6, nylon-66, nylon-10, nylon-11, nylon-12 and copolymers thereof, melt-spinnable polyesters such as polyethylene terephthalate, polybutylene terephthalate and cation-dyeable type modified polyethylene terephthalate, melt-spinnable polyolefines such as polypropylene and copolymer thereof, and the like. Of course, two or more polymers may be mixed and used.

On the other hand, the polymer constituting the sea component (the polymer that should be extracted and removed) is a polymer whose solubility or decomposability against a solvent or a decomposing agent is different from that of the island component polymer (the polymer constituting the sea component has high solubility or decomposability), whose affinity for the island polymer is small, and whose surface tension is small or whose melt viscosity is lower than that of the island component present in the same melt system. Examples thereof include at least one melt-spinnable polymer which is selected from polymers that can easily be dissolved, such as polyethylene, polystyrene, modified polystyrene and ethylene/propylene copolymers, and polymers that can easily be decomposed, such as polyethylene terephthalate modified (copolymerized) with sodium sulfoisophthalate, polyethylene glycol, or the like.

From the viewpoint of melt spinning stability, it is preferred to select a polymer having a melting point suitable for temperature at which the elastic polymer can be melt-spun as the non-elastic polymer and the polymer constituting the sea component. For example, in the case that any one of polyurethanes is used as the elastic polymer, the melting points of the non-elastic polymer and the polymer constituting the sea component are preferably about 230° C. or lower. In the case that any one of polyester elastomers and polyamide elastomers is used as the elastic polymer, the melting points of the non-elastic polymer and the polymer constituting the sea component are preferably about 260° C. or lower.

The fineness, the number of strands and the fiber length of the microfine fibers constituting the island component of a flow of the blended polymers can be adjusted by changing the combination of the blend ratio between the non-elastic polymer or the elastic polymer constituting the flow and the sea component polymer, the melt viscosity thereof, the surface tension thereof, and the like. In general, if the blend ratio of the polymer constituting the island component to the sea component polymer is made high, the number of strands of the island component fibers increases. If the melt viscosity and the surface tension of the island polymer are made high, the following tendency is exhibited: the fineness increases, the number of strands of the fibers decreases, and the fiber length is shortened. On the basis of this tendency, the fineness, the number of strands and the fiber length of the non-elastic polymer or the elastic polymer, constituting the island component, of the blended-polymers-flow in the microfine fiber-forming fibers can be recognized by combining appropriately the polymer constituting the island component and the polymer constituting the sea component in the blended-polymers-flow and then test-spinning the combination, according to actual spinning temperature and speed.

Finite is the length of the island component fibers in the fibers obtained from the blended-polymers-flow wherein the non-elastic polymer or the elastic polymer and the sea component polymer are blended and melted in a single melting system. However, the length is preferably 5 mm or more in order to keep mechanical properties based on entanglement with the microfine fibers or the agglutination entanglement with the non-elastic microfine fibers (B) and the elastic it microfine fibers (A), and suppress the elongation of base cloth in the process. It is however difficult in the art to obtain microfine by fibers having a length of 80 cm or more by blend spinning. The fiber length of the non-elastic polymer or the elastic polymer obtained from the blended-polymers-flow can be changed at will by selecting a combination of the non-elastic polymer or the elastic polymer and the sea component polymer upon spinning. In the case that any one of polymers selected from the above-mentioned polyurethanes, polyester elastomers and polyamide elastomers is used as the constituent elastic polymer, it is possible to obtain fiber's which are excellent in melt spinning stability and have a sufficiently long fiber length. Moreover, such a polymer has a large fractional resistance against the non-elastic microfine fibers (B) to have a sufficient effect for fixing the fibers. Thus, such a case is optimum. In the case that blend spinning is not used but composite spinning issued, the fiber length of the resultant microfine fibers is infinite. However, in the case that the microfine fibers are made up to artificial leather, the fibers are usually cut to be used as staple fibers. Thus, the fiber length does not exceed the fiber length of staple fibers.

If necessary, the microfine fiber-forming fibers are subjected to treatment steps such as stretching, crimping, heat setting and cutting, so as to be made into fibers having a fineness of 1 to 20 deniers. The fineness and the average fineness referred to in the present invention can easily be determined from the cross sections of the microfine fiber-forming fibers. That is, a cross section of the microfine fiber-forming fibers is photographed with a microscope, and then the respective number of strands of the elastic microfine fibers (A) and the non-elastic microfine fibers (B) in the fiber section are counted. The respective weights of the elastic microfine fiber (A) constituting a fiber of 9000 m in length and the non-elastic microfine fiber (B) constituting the same fiber are divided by the above-mentioned respective numbers. By photographing across section of fiber bundles constituting a fibrous substrate in this way, it is possible to obtain easily the average fineness of the elastic microfine fibers (A) and the non-elastic microfine fibers (B), the number of strands thereof and the ratio between the numbers. The weight ratio between the elastic microfine fibers (A) and the non-elastic microfine fibers (B) can also be obtained by selecting any one of solvents which have different solubility or decomposability against the elastic microfine fibers (A) and the non-elastic microfine fibers (B) and then removing only the elastic microfine fibers (A) or only the non-elastic microfine fibers (B) from the fibrous substrate. It is easy to know whether or not the fiber length is 5 mm or more by producing a fiber-entangled nonwoven cloth, converting the elastic polymer and the non-elastic polymer to fiber bundles, taking out the bundle and observing it with a microscope. The number of strands of the microfine fibers (A) and (B), referred to in the present invention, is an average value. The ratio between the numbers is a ratio between the average values of the numbers.

In the present invention, the microfine fibers are preferably composed only of the elastic microfine fibers (A) and the non-elastic microfine fibers (B). However, fibers that do not fall within the scope of the present invention may be incorporated in a small amount so far as the texture and appearance of the present invention are not damaged. One or more various stabilizers, coloring agents and the like may be incorporated into the fibers.

The microfine fiber-forming fibers are opened with a card, passed through a webber to form random webs or cross-lap webs. The resultant webs are laminated to desired weight and thickness. The laminated webs are then subjected to a known entangling treatment such as needle punching or water-jet entanglement to convert the webs to a nonwoven fabric. Of course, at the time of the conversion to the nonwoven fabric, other microfine fibers, microfine fiber-forming fibers, ordinary fibers and the like may be added so far as the object of the present invention is not highly damaged. If necessary, a resin which can be dissolved away, for example, a polyvinyl alcohol-based by resin, may be added to the nonwoven fabric to set the same provisionally.

If necessary, the fiber-entangled nonwoven fabric may be impregnated with a solution or an emulsion of a nonfibrous elastic polymer in a small amount and coagulated for the purpose of adjustment of texture and the like. However, when the amount of the nonfibrous elastic polymer is large, texture like natural leather cannot be obtained. Therefore, the amount is preferably about 10% or less by weight based on the fibrous substrate. Examples of suitable elastic polymers with which the fiber-entangled nonwoven fabric is impregnated include polyurethanes obtained by reacting at least one selected from polymer diols having a number-average molecular weight of 500 to 3500, such as polyester diols, polyether diols, polyether ester diols, polycarbonate diols and the like with at least one diisocyanate selected from aromatic, alicyclic and aliphatic diisocyanates such as 4,4'-diphenylmethane diisocyanate, isophorone diisocyanate or hexamethylene diisocyanate and a low molecular weight compound having two or more active hydrogen atoms, such as ethylene glycol or ethylenediamine at a prescribed molar ratio. Such a polyurethane is used as a polymer composition to which a polymer such as synthetic rubber or polyester elastomer is optionally added. The elastic polymer such as polyurethane is dissolved in a solvent or is dispersed in a non-solvent such as water, and then the fiber-entangled nonwoven fabric is impregnated with the resultant polymer solution. The resultant product is treated with a non-solvent for the polymer to effect wet coagulation, or is heat-treated or treated with hot water to effect dry coagulation or hot water coagulation. Thus, a fibrous substrate is obtained. An additive or additives such as a coloring agent, coagulation regulator or an antioxidant may be added to the polymer solution.

Next, the fibrous substrate is treated with a liquid which is a non-solvent for the non-elastic-polymer, the elastic polymer and the polymer used for the impregnation and which is a solvent or a decomposing agent for the sea component of the microfine fiber-forming fibers. For example, toluene is used when the non-elastic polymer is nylon, polyethylene terephthalate or polypropylene, the elastic polymer is a polyurethane, an ester elastomer or an amide elastomer and the sea component is polyethylene. An aqueous caustic soda solution is used when the non-elastic polymer is nylon, polyethylene terephthalate or polypropylene, the elastic polymer is a polyurethane or an amide elastomer and the sea component is an easily alkali-decomposable polyester. By this treatment, the sea component polymer is removed from the microfine fiber-forming fibers of the present invention so that the fibers are converted to microfine fiber bundles wherein the non-elastic microfine fibers (B) and the elastic microfine fibers (A) are blended and integrated with each other. At the same time, the elastic polymer is swelled with the solvent so that the non-elastic microfine fibers (B) near the elastic microfine fibers (A) are bound. As a result, soft microfine fiber bundles like natural leather are obtained wherein both of the elastic microfine fibers (A) and the non-elastic microfine fibers (B) are divided into microfibers and the microfine fibers gather densely.

The thus obtained sheet is substantially composed only of the microfine fiber bundles described above. Therefore, the sheet has a fibrous substrate structure like natural leather. As a result, the sheet has texture and appearance like natural leather, which is different from artificial leather in the prior art, and is applicable, as a suede type or a grain-like type, to wide goods such as clothing, furniture, shoes and bags. The sheet of the present invention is especially useful for fields of high-class grain-like goods and high-class suede goods.

The suede type sheet can be obtained by napping at least one surface of the fibrous substrate, dyeing the suede type fibrous substrate in a normal dyeing manner using a dye made mainly of an acidic dye, a premetallized dye, a dispersed dye or the like, and optionally subjecting the dyed suede type fibrous substrate to finishing treatment such as rubbing, softening and brushing.

On the other hand, concerning the grain-like type, a surface coating layer that will be the grain-like face layer is formed as follows: (1) a transcription method of applying a solution or a dispersion solution of an elastic polymer such as polyurethane, to which a coloring agent may be optionally added, to a releasable supporter, and jointing/integrating the supporter with a fiber-entangled nonwoven fabric before the applied coat layer loses adhesiveness, or drying the coat layer and jointing/integrating the dried coat layer with a fiber-entangled nonwoven fabric by means of a soft adhesive agent; (2) a method comprising applying a solution or a dispersion solution of an elastic polymer such as polyurethane directly to a fiber-entangled nonwoven fabric with a gravure roller; or (3) a coating method comprising i) carrying out, for example, a process of applying such a solution or a dispersion solution in a roller coating manner, performing wet coagulation, drying and surface-coloring to form a surface coat layer, and then ii) finishing the layer with embossing. If the surface finishing of the grain-like leather on which the surface coat layer is formed is insufficient, a polyurethane solution containing a coloring agent or no coloring agent is applied to this sheet to adjust color or gloss. The sheet is optionally subjected to finishing treatment such as softening, dyeing treatment or a treatment with a water repellent, and is subsequently subjected to rubbing, embossing or the like treatment, so as to make a grain-like leather. As described above, any method that is generally used may be used.

The following will describe embodiments of the present invention by way of working examples. The present invention is not however limited to these examples. Parts and percentage in the examples are by weight unless specified otherwise. The ratio of the swelling of the non-elastic microfine fibers (B) with an extracting solvent was be calculated as follows. Components other than the non-elastic microfine fibers (B) were removed from the resultant artificial leather, leaving the non-elastic microfine fibers (B). Thereafter, the non-elastic microfine fibers (B) were vacuum-dried at 50–100° C. for 20 hours and then formed into a film 100 $\mu$m in thickness at a temperature at which the non-elastic microfine fibers (B) could be thermally melted by means of a press molding machine. The film was cut into squares, each side of which was 10 cm, and then the weight (W0) of the square was measured. Thereafter, the square was immersed in an extracting solvent at an extracting temperature for 1 hour and then the solvent adhering to the surface was wiped out. The weight (W) of the resultant square was measured. The swelling ratio was calculated according to the following calculating equation.

The swelling ratio (% by weight) of the non-elastic microfine fibers (B)=(W−W0)×100/W0

EXAMPLE 1

A melt formed by melting 40 parts of nylon-6 [a non-elastic polymer constituting the non-elastic microfine fibers (B)] and 40 parts of polyethylene (melt index=70) in a single system, and a melt formed by melting 20 parts of a polyester-based polyurethane [an elastic polymer constituting the elastic microfine fibers (A)] in another system were spun in the manner that the number of the islands of the elastic polymer would be 25 by a spinning method of defining the fiber shape at a spinneret portion. Thus, microfine fiber-forming fibers were obtained which had a fineness of 15 deniers, a ratio between the number of strands (A/B) of 1/24, and a weight ratio (A/B) of 33/67. At this time, a cross section of the fibers was observed. As a result, the average number of strands of the non-elastic microfine fibers (B) composed of nylon-6 was about 600. The polyester-based polyurethane and nylon-6 were substantially homogeneously dispersed and the non-elastic microfine fibers (B) composed of nylon-6 encircled each of the polyester-based polyurethane microfine fibers (A). The resultant fibers were stretched by 3.0 times, crimped, cut to a fiber length of 51 mm, opened with a card, and formed into webs with across-lap webber. Next, the webs were converted to a fiber-entangled nonwoven fabric having a basic weight of 700 g/cm$^2$ with a needle punch. During these steps, the size of the fibers was reduced to about 5.9 deniers. This fiber-entangled nonwoven fabric was impregnated with an aqueous polyurethane emulsion composition containing 3% polyether-based polyurethane (the added amount of the polyurethane: 2% of the fibers after the fibers were made microfine), and then thermally treated. Polyethylene in the microfine fiber-forming fibers was then extracted and removed with toluene at 90° C. The ratio of the swelling of the non-elastic microfine fibers (B) with 90° C. toluene was 1%. The treatment for removing the sea component gave a fibrous substrate of about 1.3 mm in thickness comprising microfine fiber bundles wherein the polyester-based polyurethane microfine fibers (A) and nylon-6 were mixed and intergrated with each other, and nonfibrous polyurethane (the content by weight=2% by weight).

According to observation of a cross section of the microfine fiber bundle of this fibrous substrate with an electron microscope, the microfine fiber (A) comprising the polyester-based polyurethane was separated into about 25 strands, and the polyester-based polyurethane microfine fibers hardly agglutinated to each other. Moreover, it was found that this fiber had a structure wherein the microfine fiber (A) comprising the polyester-based polyurethane and the microfine fibers (B) were mixed and integrated with each other and they agglutinated partially and that the non-elastic microfine fibers (B) encircled each of the microfine fibers (A). The average fineness of the microfine fiber (A) comprising the polyester-based polyurethane was 0.055 denier and a scattering in the fineness was hardly recognized. The average fineness of the microfine fibers comprising nylon-6 was 0.004 denier. The fiber length of most of the microfine fibers (B) comprising nylon-6 was 5 mm or more. One surface of this substrate was subjected to buffing to adjust its thickness to 1.20 mm. Thereafter, the other surface was subjected to an emery buffing machine to form a microfine fiber-napped surface. The substrate was further dyed with Irgalan Red 2GL (made by Chiba Geigy) having a concentration of 4% owf, and was finished. The resultant suede-like artificial leather was soft and had weak repellence feeling and rubbery feeling. The leather also had drapeability and texture like natural leather, was excellent in color-developability, and exhibited elegant lighting. Its appearance was also very good.

The above-mentioned fibrous substrate was finished into a grain-like artificial leather in the following manner. As a result, the leather was soft. The leather also had weak repellence feeling and rubbery feeling, and texture like natural leather. Its crease feeling was like natural leather and its appearance was excellent.

The manner for finishing into the grain-like artificial leather: one surface of the above-mentioned fibrous substrate was subjected to buffing to adjust its thickness to 1.20 mm. The surface was then brought into contact with a flat roller of 120° C. to conduct surface smoothing treatment, and was subsequently coated with a 20% polyurethane solution by means of a gravure roller. Further, the surface was coated with a 10% polyurethane solution by means of the gravure roller. The polyurethane-coated surface was embossed with a heated embossing roller to finish the substrate into the grain-like artificial leather. The resultant grain-like artificial leather had high-class feeling having texture and appearance like natural leather.

EXAMPLE 2

The same operation as in Example 1 was performed except that nylon-6 of the non-elastic polymer was replaced with a copolymer of nylon-6 and nylon-66, to obtain a suede-like artificial leather. The swelling ratio of the non-elastic microfine fibers was 3%. The resultant suede-like artificial leather had texture like natural leather in the same manner as in Example 1. Results from observation with an electron microscope were also the same as in Example 1. Its appearance was also good.

EXAMPLE 3

The same operation as in Example 1 was performed except that the polyester-based polyurethane of the elastic polymer and nylon-6 of the non-elastic polymer were replaced with a polyether-based ester elastomer and 10 mol %-isophthalic acid modified polyethylene terephthalate, respectively, and a dispersed dye was used as a dye, to obtain a suede-like artificial leather. The swelling ratio of the non-elastic microfine fibers was 7%. The resultant suede-like artificial leather had texture like natural leather in the same manner as in Example 1. Its, appearance was also good.

COMPARATIVE EXAMPLE 1

The same operation as in Example 1 was performed except that the spinning method of defining the fiber shape at the spinneret portion was replaced with a spinning method of repeating joint/division at a spinning heat portion to form a blend system of the two, and the 25 islands of the elastic polymer were replaced with 10 islands thereof, so as to obtain a suede-like artificial leather. According to observation of a section of the microfine fiber bundle with an electron microscope, it was expected that the number of the islands of the polyester-based polyurethane was 100 but the polyester-based polyurethane fibers adhered and agglutinated to be integrated with each other. The nylon-6 fibers were embraced therein. The resultant suede-like artificial leather was harder, and had more paper-like texture and poorer surface lighting and appearance, as compared with that of Example 1.

COMPARATIVE EXAMPLE 2

The same operation as in Example 1 was performed except that the melt index of polyethylene was changed from 70 to 120, the number of the islands of nylon-6 was changed from 600 to 100, the number of strands of the polyester-based polyurethane was changed to 40, and the ratio between the numbers of strands was changed from 1/24 to 1/2.5, so as to obtain a suede-like artificial leather. According to observation of a cross section of the microfine fiber bundle with a microscope, it was expected that the ratio of the numbers of strands between the polyester-based polyurethane and nylon-6 was 1/2.5 but the polyester-based polyurethane fibers agglutinated to be integrated with each other. The nylon-6 fibers were embraced therein. Thus, the numbers of strands and the ratio between the numbers of strands were not able to be counted. The resultant suede-like artificial leather was harder, and had more paper-like texture and poorer surface lighting and appearance, as compared with that of Example 1.

COMPARATIVE EXAMPLE 3

The same operation as in Example 1 was performed except that the weight ratio of the polyester-based polyurethane to nylon-6 was changed from 33/67 to 5/95, so as to obtain a suede-like artificial leather. According to observation of a cross section of the microfine fiber bundle with an electron microscope, the polyester-based polyurethane was microfibers but the microfine fibers comprising nylon-6 were hardly bound to the microfine fibers comprising the polyester-based polyurethane. Its structure was loose. The resultant suede-like artificial leather had more paper-like texture than that of Example 1. A great deal of surface nap fell out. Its appearance was poor.

COMPARATIVE EXAMPLE 4

The same operation as in Example 1 was performed except that the weight ratio of the polyester-based polyurethane to nylon-6 was changed from 33/67 to 80/20, so as to obtain a suede-like artificial leather. According to observation of a cross section of the microfine fiber bundle with an electron microscope, the polyester-based polyurethane fibers agglutinated to be integrated with each other. The nylon-6 fibers were embraced therein. The resultant suede-like artificial leather was harder, and had texture having stronger repellence feeling and rubbery feeling, as compared with that of Example 1. This leather also had poorer surface lighting and appearance.

COMPARATIVE EXAMPLE 5

The same operation as in Example 1 was performed except that the number of the islands of the polyester-based polyurethane was set up to 1 instead of 25, so as to obtain a suede-like artificial leather. According to observation of a cross section of the microfine fiber bundle with an electron microscope, the bundle had a structure wherein one strand of the polyester-based polyurethane fiber having an average fineness of 1.5 denier and the nylon-6 fibers were mixed and integrated with each other. The resultant suede-like artificial leather exhibited texture having stronger repellence feeling than the artificial leather of Example 1, had in its surface white, striking napped markings, and gave rough touch and poor appearance and surface feeling.

COMPARATIVE EXAMPLE 6

The same operation as in Example 1 was performed except that the spinning method of defining the fiber shape at the spinneret portion in the manner that the number of the islands of the elastic polymer would be 25 was replaced with a spinning method using a spinneret having a side-by-side type structure, and the 25 islands of the elastic polymer were replaced with a single prejudiced core, so as to obtain a suede-like artificial leather. According to observation of a cross section of the microfine fiber bundle with an electron microscope, pieces of unevenly distributed polyester-based polyurethane adhered to each other and a part of the nylon-6 fibers was embraced therein. The resultant suede-like artificial leather was harder and had more paper-like texture and poorer surface lighting and appearance, as compared with that of Example 1.

Effect of the Present Invention

The fibrous substrate for artificial leather obtained by the present invention has texture and appearance like natural leather. Thus, the substrate is applicable, as a suede type or a grain-like type, to various goods for clothing, furniture, shoes, bags and the like. The fibrous substrate for artificial leather of the present invention is especially useful in the field of high-class grain-like goods and high-class suede-like goods which could have heretofore been obtained from only natural leather.

What is claimed is:

1. A fibrous substrate for artificial leather, comprising microfine fiber bundles, each of which is composed of 5–50 numbers of microfine fibers (A) comprising an elastic polymer and having an average fineness of 0.2 denier or less and 25 or more numbers of microfine (B) comprising a non-elastic polymer and having an average fineness of 0.2 denier or less, wherein the elastic fibers (A) and the non-elastic microfine fibers (B) are substantially dispersed in the whole of any cross section of the bundle without locally uneven distribution, the microfine fiber bundles satisfying the following conditions (1)–(3):

(1) a ratio of strands (A/B) is 1/5 or less when observed in a cross section of the microfine fiber-forming fiber, (2) a weight ratio (A/B) is 10/90–60/40, (3) the microfine fibers (B) encircle each of the microfine fibers (A), each of the fiber bundles being formed from a microfine fiber-forming fiber comprising an island component and a sea component by removing the sea component by solvent extraction, wherein the island component comprises 5–50 numbers of microfine fibers (A) comprising an elastic polymer and having an average fineness of 0.2 denier or less and 25 or more numbers of microfine fibers (B) comprising a non-elastic polymer and having an average fineness 0.2 denier or less, and satisfies the following conditions (1)–(3):

(1) a ratio of strands (A/B) is 1/5 or less when observed in a cross section of the microfine fiber-forming fiber, (2) a weight ratio (A/B) is 10/90 –60/40, and (3) the microfine fibers (B) encircle each of the microfine fibers (A).

2. The fibrous substrate for artificial leather according to claim 1, wherein a fineness ratio (A/B) ranges from 2 to 5000.

3. The fibrous substrate for artificial leather according to claim 1, wherein the elastic polymer is polyurethane.

4. The fibrous substrate for artificial leather according to claim 1, wherein the non-elastic polymer is at least one polymer selected from the group consisting of polyamides, polyesters and polyolefines.

5. The fibrous substrate for artificial leather according to claim 1, wherein the fibrous substrate is impregnated with the elastic polymer in an amount of 10% or less by weight of the microfine fibers constituting the substrate.

6. A suede artificial leather obtainable by napping at least one surface of the substrate according to claim 1.

7. An artificial leather, having a grain face layer, obtainable by coating at least one surface of the substrate according to claim 1 with a resin layer.

8. The fibrous substrate according to claim 1, wherein each of the microfine fiber bundles comprises 5 to 45 numbers of microfine fibers (A).

9. The fibrous substrate according to claim 1, wherein each of the microfine fiber bundles comprises 50 or more numbers of microfine fibers (B).

10. The fibrous substrate according to claim 1, wherein the ratio of strands (A/B) is 1/10 or less.

11. The fibrous substrate according to claim 1, wherein the ratio of strands (A/B) is 1/10–1/2,000.

12. The fibrous substrate according to claim 1, wherein the weight ratio (A/B) is in the range of 15/85 to 55/45.

13. The fibrous substrate according to claim 1, wherein the average fineness of the microfine fibers (A) is 0.2–0.005 denier.

14. The fibrous substrate according to claim 1, wherein the average fineness of the microfine fibers (B) is 0.15 . 0.0002 denier.

15. A fabric comprising microfine fiber-forming fibers, each of which comprises an island component and a sea component, the island component comprising 5–50 numbers of microfine fibers (A) comprising an elastic polymer and having an average fineness of 0.2 denier or less and 25 or more numbers of microfine fibers (B) comprising a non-elastic polymer and having an average fineness of 0.2 denier or less, and satisfying the following requirements (1) to (3):

(1) a ratio of strands (A/B) is 1/5 or less when observed on a cross section of the microfine fiber-forming fiber, (2) a weight-ratio (A/B) is 10/90–60/40, and (3) the microfine fibers (B) encircle each of the microfine fibers (A).

* * * * *